US009608365B2

(12) United States Patent
Kroeckel

(10) Patent No.: US 9,608,365 B2
(45) Date of Patent: Mar. 28, 2017

(54) DIRECT PLUG-IN ELEMENT WITH INTEGRATED LOCKING MECHANISM

(75) Inventor: Markus Kroeckel, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/232,692

(22) PCT Filed: Jul. 6, 2012

(86) PCT No.: PCT/EP2012/063316

§ 371 (c)(1),
(2), (4) Date: Jan. 14, 2014

(87) PCT Pub. No.: WO2013/007659

PCT Pub. Date: Jan. 17, 2013

(65) Prior Publication Data

US 2014/0213092 A1 Jul. 31, 2014

(30) Foreign Application Priority Data

Jul. 14, 2011 (DE) ..... 10 2011 079 136

(51) Int. Cl.
*H01R 13/62* (2006.01)
*H01R 43/26* (2006.01)
*H01R 13/428* (2006.01)

(52) U.S. Cl.
CPC ..... *H01R 13/62* (2013.01); *H01R 13/428* (2013.01); *H01R 43/26* (2013.01); *Y10T 29/49224* (2015.01)

(58) Field of Classification Search
CPC ..... H01R 13/432; H01R 43/16; H01R 13/62; H01R 43/26

(Continued)

(56) References Cited

U.S. PATENT DOCUMENTS 3,037,183 A * 5/1962 Hopkins ..... H01R 13/115 29/513
3,530,429 A 9/1970 Scheller
(Continued)

FOREIGN PATENT DOCUMENTS

CN 101147297 3/2008
DE 19808727 9/1999
(Continued)

OTHER PUBLICATIONS

International Search Report for Application No. PCT/EP2012/063316 dated Oct. 9, 2012 (3 pages).

*Primary Examiner* — Amy Cohen Johnson
*Assistant Examiner* — Oscar C Jimenez
(74) *Attorney, Agent, or Firm* — Michael Best & Friedrich LLP

(57) ABSTRACT

The invention relates to a direct plug-in element comprising: a plug housing (3), a direct contact (4) with a contact tongue (5), the contact tongue (5) having at least one contact section (50) for directly contacting an exposed contact area on a counterpart, and a catch device (6) for an interlocked connection between the plug housing (3) and the direct contact (4), in order to retain the direct contact (4) in the plug housing (3), the direct contact (4) being arranged in the plug housing (3), the contact tongue (5) having a first and second flat side (52, 53) and a first and second narrow side (54, 55), the catch device (6) comprising a first catch element (60) on the direct contact (4) and a second catch element (61) formed on the plug housing (3) complementary to the first catch element (60), the first catch element (60) being arranged on one of the flat sides (52, 53) of the direct contact (4), and the contact section (50) being arranged on one of the narrow sides (54, 55) of the contact tongue (5).

16 Claims, 7 Drawing Sheets

(58) Field of Classification Search
USPC ..... 439/345, 746, 346, 848, 849; 310/71
See application file for complete search history.

(56) References Cited

U.S. PATENT DOCUMENTS

| | | | | | |
|---|---|---|---|---|---|
| 3,825,880 | A | | 7/1974 | Battaglia et al. | |
| 3,923,365 | A | | 12/1975 | Lynch | |
| 4,018,495 | A | | 4/1977 | Freitag | |
| 4,037,911 | A | | 7/1977 | Anhalt et al. | |
| 4,296,988 | A | * | 10/1981 | Warner | 439/398 |
| 4,482,198 | A | * | 11/1984 | Crowley | 439/514 |
| 4,671,590 | A | | 6/1987 | Ignasiak | |
| 5,260,549 | A | * | 11/1993 | Garritano B32B | 17/10036 219/203 |
| 5,848,918 | A | * | 12/1998 | Warner et al. | 439/746 |
| 6,290,525 | B1 | | 9/2001 | Jacobi | |
| 7,663,561 | B2 | * | 2/2010 | Hisaeda B32B | 17/10036 343/713 |
| 7,766,690 | B2 | * | 8/2010 | Walker et al. | 439/447 |
| 7,938,678 | B1 | | 5/2011 | Lee et al. | |
| 2003/0118462 | A1 | | 6/2003 | Nagasaka et al. | |

FOREIGN PATENT DOCUMENTS

| | | |
|---|---|---|
| DE | 10007138 | 9/2000 |
| DE | 202006005024 | 5/2006 |
| EP | 0068656 | 1/1983 |
| EP | 0133377 | 2/1985 |
| FR | 1422508 | 12/1965 |
| GB | 405733 | 2/1934 |
| GB | 2201049 | 8/1988 |
| JP | H11283722 | 10/1999 |
| JP | 2009266609 | 11/2009 |

* cited by examiner

DIRECT PLUG-IN ELEMENT WITH INTEGRATED LOCKING MECHANISM

BACKGROUND OF THE INVENTION

The present invention relates to a direct plug-in element with a plug housing and a direct contact for directly contacting exposed contact regions on a counterpart, for example a printed circuit board, as well as to an electric arrangement with a direct plug-in element of this type.

Recently, more and more direct plug-in contacts are used where a direct plug-in element is plugged directly onto a counterpart, such as, for example, a printed circuit board or a pressed screen or substrate. In particular when used in the area of vehicles, however, there are increased demands with regard to a ruggedness and contact reliability of these types of direct plug-in connections. Up to now, the design of direct plug-in elements has been expensive where direct contacts are pressed onto a counterpart or are latched in a plug housing by means of additional components. It is desirable, however, in particular in the case of mass produced products such as, for example, direct plug-in elements for control devices in vehicles, to provide as simple a design as possible which has a high level of contact reliability and is additionally economic to produce.

SUMMARY OF THE INVENTION

The advantage of the direct plug-in element of the invention is that no additional components are necessary on a counterpart to generate the contact force and a direct contact is self-latching. Consequently, a simply constructed direct plug-in element with an integrated locking mechanism is provided. This is achieved by the invention in that the direct plug-in element comprises a plug housing and a direct contact having a contact tongue, wherein the contact tongue has at least one contact portion for directly contacting an exposed contact region on a counterpart. In addition, a latching mechanism is provided between the plug housing and the direct contact in order to keep the direct contact, which is arranged in the plug housing, in the plug housing. The latching mechanism has a first latching element on the direct contact, which is set up in order to enter into a latching connection with a second latching element, which is formed in a complementary manner to the first latching element, on the plug housing. In this connection, the first latching element is arranged on a flat side of the direct contact and the contact portion is arranged on one of the narrow sides of the contact tongue. Provided as a result is a direct plug-in element with a latching mechanism which enables automatic latching of the direct contact with the plug housing by virtue of the respective inherent forms of the same. Cost-efficient and economic mass production of the components is achieved as a result of the minimized number of components. The contact tongue of the invention consequently has a very flexible spring function as the contact tongue can be long in length, preferably more than half, in a particularly preferred manner more than ¾ of an overall length of the direct plug-in element. In this case, the contact tongue of the invention is very sturdy and can also withstand higher loads. This is a considerable advantage in particular in the case of miniaturized contacts.

In a preferred development of the invention, the contact tongue has a first and second contact portion, wherein in each case one of the contact portions is arranged on one of the narrow sides of the contact tongue. The oppositely situated, lateral arrangement of the contact portions on the contact tongue ensures direct contacting of the contact regions of the counterpart in a particularly operationally reliable manner under all operating conditions and types of use. In addition, the contact tongue can be produced in a cost-efficient manner in short cycle times for example by means of simple pressing steps and/or embossing.

In a particularly preferred manner, the contact tongue is formed in a curved manner and has resilient characteristics in the direction of the latching mechanism. In addition in a preferred manner, the first latching element is arranged on a convex region of the curved contact tongue. During the latching operation, as a result of said shaping the contact tongue is able to deflect elastically at right angles with respect to an insertion direction or by virtue of its inherent form is able to be bent such that the first latching element is able to be pushed over the second latching element on the plug housing and latches automatically with the same. No additional components are necessary in this connection for the deflecting and latching function. The latching element, in this case, is preferably connected in a rigid manner to the curved and elastically deformable contact tongue.

In a preferred development of the invention, the latching connection is releasable. As a result, it is possible to exchange the components of the direct plug-in element and/or of the cable in the event of a repair being required.

In addition in a preferred manner, the plug housing has an end-face opening. By means of a special dismantling tool which is inserted into the end-face opening of the plug housing, the first latching element on the direct contact can be deformed elastically at right angles to the insertion direction and lifted above the second latching element on the plug housing. As a result, the latching is lifted and the direct contact can be pulled out of the plug housing on the cable in a simple manner. In a preferred manner, the curved contact tongue of the direct contact can be deformed elastically at right angles to the insertion direction for this purpose and consequently the first latching element can be lifted above the second latching element on the plug housing.

A second latching mechanism is preferably formed between the direct contact and the plug housing. As a result, redundant latching between the components can be achieved which ensures a high level of contact reliability of the direct plug-in element even under difficult conditions.

In addition in a preferred manner, the direct contact is aligned substantially in the direction of a cable which is fixed on the direct contact, for example by means of crimping or welding. The linear alignment makes for a compact design of the direct plug-in element with minimum overall height and in addition enables simple fitting in the plug housing or removal out of the plug housing.

The invention additionally relates to an electric arrangement which comprises a counterpart with exposed contact regions and a direct plug-in element of the invention.

In addition, the invention relates to a method for producing a direct contact comprising a contact tongue with at least one contact portion and one latching element, said method comprising the following steps: punch out an outer contour of the direct contact from a strip material and punch or emboss a region for the latching element on a flat side of the direct contact, wherein the direct contact is still suspended from a balance of the strip material. The contact portion is then produced by bending round at least one contour region of the outer contour and the latching element is produced by pressing out the stamped region. In the concluding operating steps the direct contact, which is still suspended from the balance of the strip material, is rotated about an angle, preferably 90°, with respect to the balance of the strip material such that the contact portion protrudes out of a strip material plane and the contact portion of the direct contact is coated with an electrically conductive material. In this connection, the contact portions are partially nickel-plated or tin-plated or gold-plated in one single electroplating process, such as for example a roll-brush method, and as a result are refined with regard to their electric conductive characteristics. The contact portions can then be cut from the balance of the strip material and separated out.

The invention is preferably used with vehicle control devices.

BRIEF DESCRIPTION OF THE DRAWINGS

An exemplary embodiment of the invention is described below with reference to the accompanying drawing, in which, in detail.

DETAILED DESCRIPTION

A direct plug-in element 2 of a preferred exemplary embodiment of the invention is described in detail below with reference to FIGS. 1 to 7.

Figure 1:
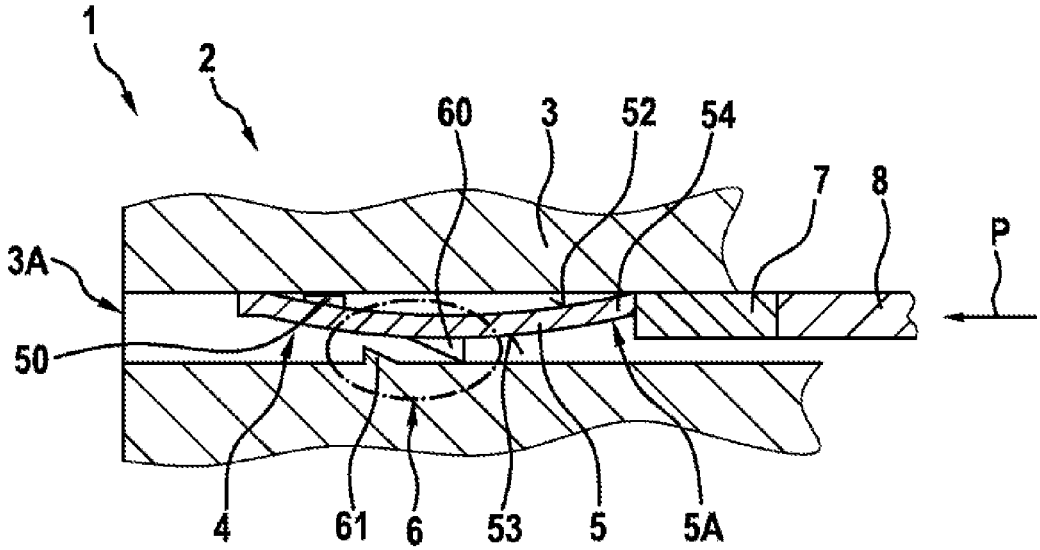
FIG. 1 shows a schematic sectional view of a direct plug-in element of a preferred exemplary embodiment of the invention in the non-latched state.
Figure 5:
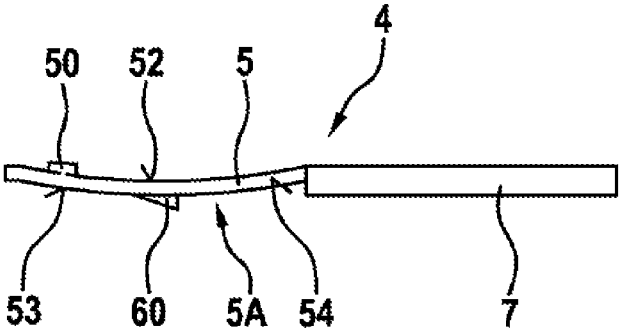
FIG. 5 shows a schematic side view of the contact tongue of the direct plug-in element of the invention of FIG. 4.
Figure 6:
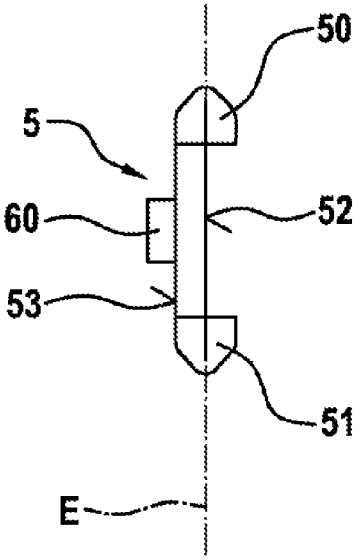
FIG. 6 shows a schematic front view of the contact tongue of the direct plug-in element of the invention of FIG. 4.

As can be seen from FIG. 1, the direct plug-in element 2 includes a plug housing 3 and a direct contact 4 which is arranged in the plug housing 3. In addition, a latching mechanism 6 is provided for a latching connection between the plug housing 3 and the direct contact 4 in order to keep the direct contact 4 in the plug housing 3. The direct contact 4 has a curved contact tongue 5 which has resilient characteristics and is connected to a cable 8 by means of a fastening portion 7. The contact tongue 5 has first and second flat sides 52 and 53 (see FIG. 6) as well as first and second narrow sides 54, 55 (see FIG. 4). The latching mechanism 6 has a first latching element 60 which is arranged on the second flat side 53 on a convex region 5A of the curved contact tongue 5 (as is also illustrated in FIG. 5). The latching element 60, in this case, is connected rigidly to the curved (elastically deformable) contact tongue 5. In addition, the latching mechanism 6 has a second latching element 61, which is formed in a complementary manner to the first latching element 60 and is realized on the plug housing 3.

In addition, a first contact portion 50 is arranged on the first narrow side 54 of the contact tongue 5. As can be seen in detail from FIG. 4 and FIG. 6, a second contact portion 51 is arranged on an opposite second narrow side 55. The first and second contact regions 50, 51, in this connection, contact exposed first and second contact regions 21, 22 on a counterpart 20, which is represented by a broken line and in this exemplary embodiment is a printed circuit board. The direct plug-in element 2 and the printed circuit board form an electric arrangement 1 of the invention.

Figure 2:
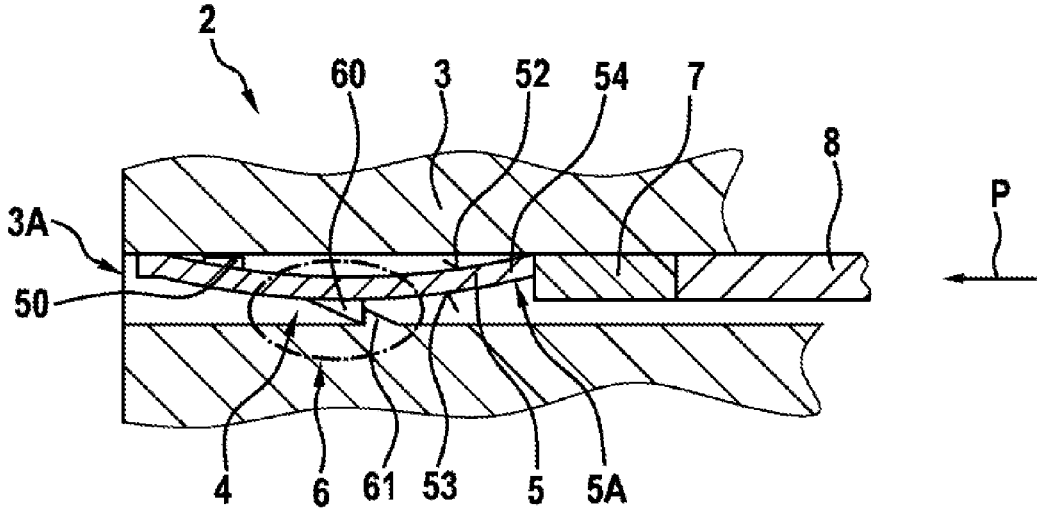
FIG. 2 shows a schematic sectional view of the direct plug-in element of FIG. 1 in the latched state.

When the direct contact 4, when fitted in the insertion direction P as shown in FIG. 2, is pushed into the plug housing 3, the curved resilient contact tongue 5 is deformed elastically at right angles to the insertion direction P in such a manner that the first latching element 60 of the direct contact 4 slides in the insertion direction P over the second latching element 61 which is arranged on the plug housing 3 and latches automatically with said second latching element.

Figure 3:
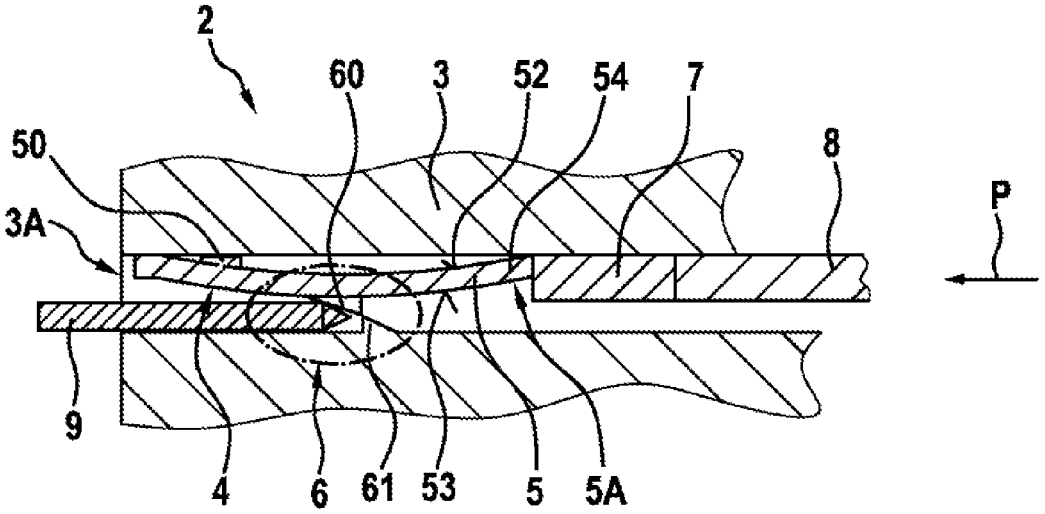
FIG. 3 shows a schematic sectional view of the direct plug-in element of FIG. 1 during a dismantling operation.
Figure 4:
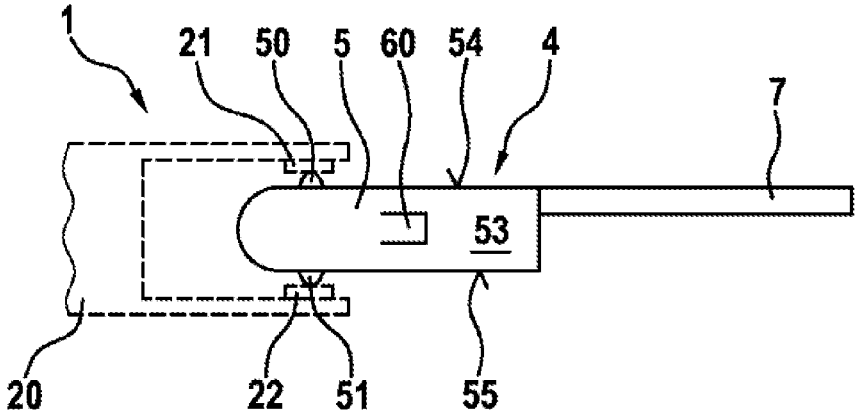
FIG. 4 shows a schematic top view of a contact tongue of the direct plug-in element of the invention of FIG. 1.

As can be seen from FIG. 3, the latching connection between the plug housing 3 and the direct contact 4 is able to be released again by means of a dismantling tool 9. To this end, the dismantling tool 9 is pushed into an end-face opening 3A of the plug housing 3 and the first latching element 60 on the contact tongue 5 is lifted at right angles to the insertion direction P over the second latching element 61. The direct contact 4 can then be pulled out of the plug housing 3 again on the fastening portion 7 or on the cable 8 in opposition to the insertion direction P.

By means of the latching mechanism 6, which is integrated in the direct plug-in element 3 of the invention, an automatic locking mechanism or latching mechanism is realized in a simple manner by virtue of the inherent form of the direct contact 4 or of the plug housing 3 with a minimized number of identical parts which can be produced in a cost-efficient and economic manner. In particular, no separate spring element is necessary for latching. Along with a compact design, the achievement above all, as a result, is substantial simplification or acceleration of the fitting operation during production. In addition, tool costs and logistics applications are clearly reduced as a result.

Figure 7:
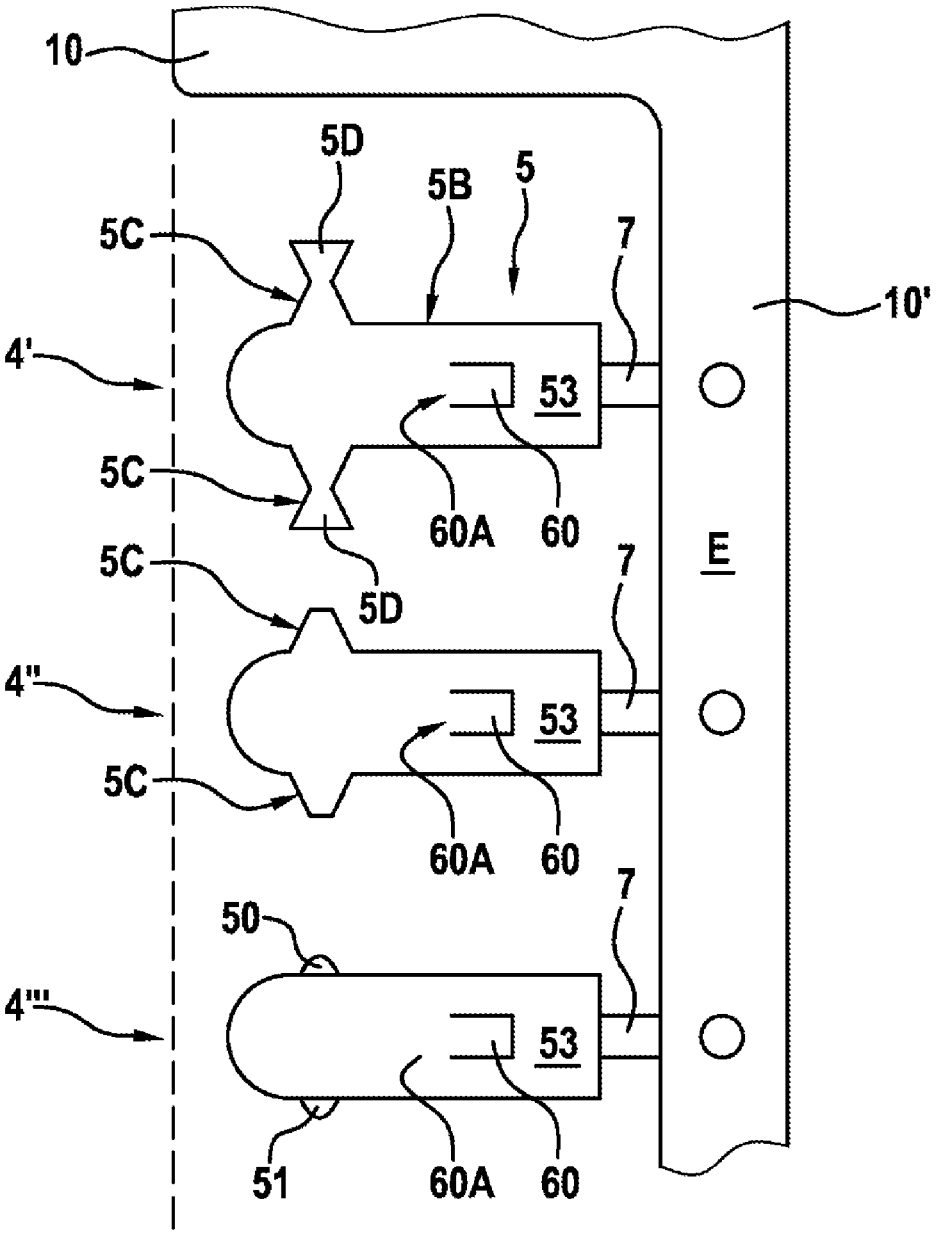
FIG. 7 shows a schematic representation of a first possibility for producing a direct contact of the direct plug-in element of the invention.

To produce the direct contact 4, as shown in FIG. 7, an outer contour 5B of the contact tongue 5 with two opposite contour regions 5C is first of all punched out from a plane E of a metal strip material 10 (given the reference 4' in FIG. 7). At the same time, a region 60A for the latching element 60 on the flat side 53 of the direct contact 4 is embossed or as an alternative punched in a U-shaped manner.

An end portion 5D of the respective contour region 5C is then bent round by 180° in the plane E (given the reference 4" in FIG. 7). The latching element 60 is subsequently produced by pushing the punched or embossed region 60A out from the flat side 53. As an option, in the event of the latching element being formed by punching, all the punched edges of the contact tongue 5 can also be round embossed. This results in the contact tongue 5 with the bent-around contact regions 50, 51 which project laterally out of the flat side 53 (given the reference 4''' in FIG. 7, cf. also FIG. 6). Said produced direct contacts 4 are still connected to a balance of the strip material 10' by means of the fastening portion 7 and can thus be rolled up for example for transport. The direct contacts 4 only have to be separated from the balance of the strip material 10' for the final assembly.

Figure 8:
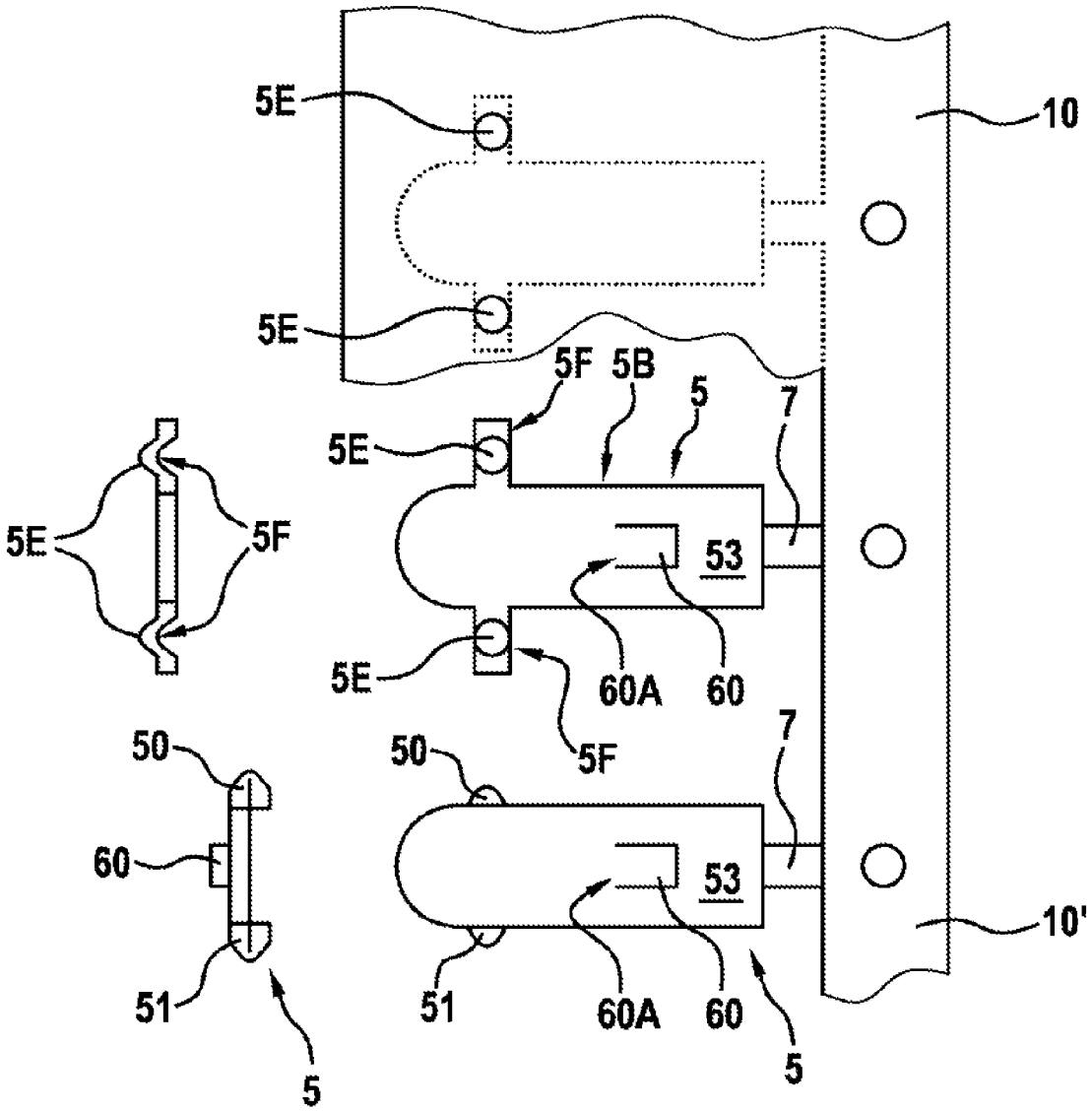
FIG. 8 shows a schematic representation of producing the direct contact in an alternative manner and FIGS. 9 to 11 show schematic representations of operating steps for producing a direct contact of the method of the invention.

As illustrated in FIG. 8, as an alternative to the above-described production, it is also possible to emboss dome-like recesses 5E in the strip material 10 first of all. The outer contour 5B, the region 60A of the latching element 60 as well as recesses 5E which are embossed in oppositely arranged contour regions 5F are then punched out, the cross sectional form also shown on the left-hand side in FIG. 8 being the result. In a following operating step, the contour regions 5F are then bent around by 180° and the contact tongue 5 is consequently produced. Defined contact portions 50, 51 can be produced by means of the embossing.

A method of the invention for producing the direct contact 4 is described below with reference to FIGS. 9 to 11.

Figure 9:
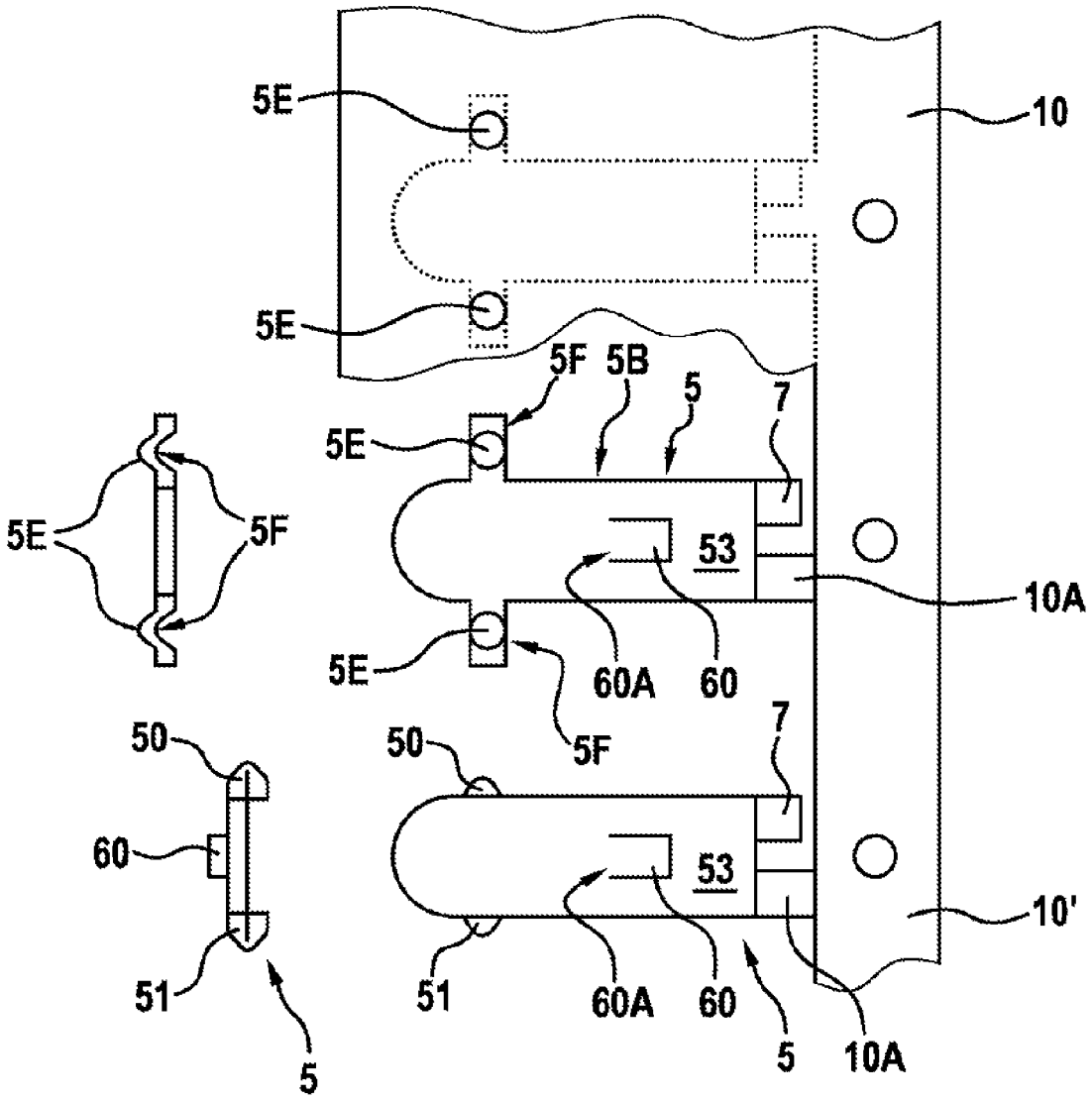
Figure 10:
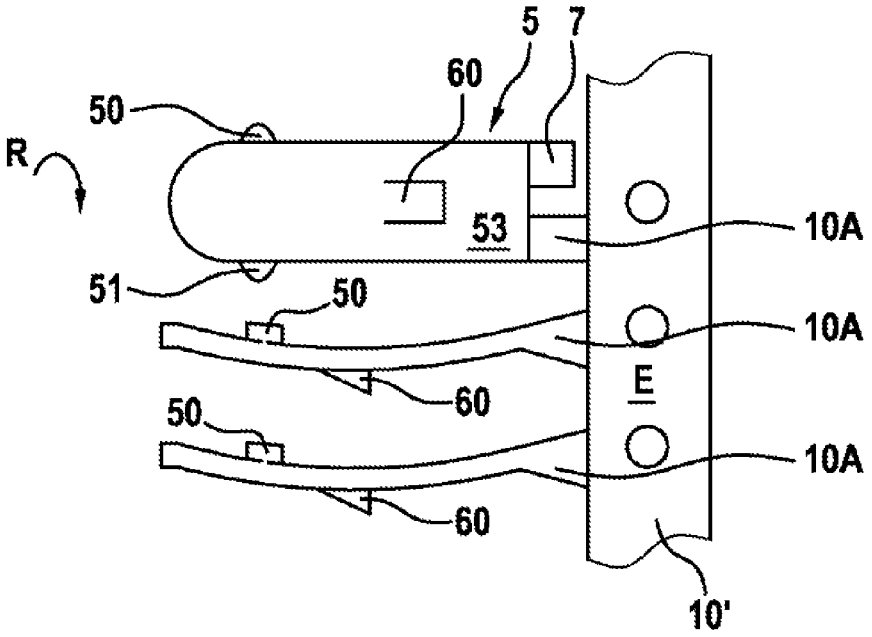

The direct contact 4 including the contact tongue 5 with the contact portions 50, 51 as well as the latching element 60 is produced, as shown in FIG. 9, with first operating steps which are identical to those of the production which has been described beforehand with reference to FIG. 8. However, in this connection, the punched outer contour 5B of the contact tongue 5 is realized such that along with the fastening portion 7 another connecting tongue 10A is provided, by means of which the contact tongue 5 is connected to a balance of the strip material 10' of the strip material 10, whilst the fastening portion 7 has already been separated off. In a subsequent operating step, the contact tongues 5, which are still suspended from the balance of the strip material 10' of the strip material 10, as illustrated in FIG. 10, are rotated (arrow R) by an angle, preferably 90°, in relation to the balance of the strip material such that the contact portions 50, 51 protrude at right angles out of the plane E of the strip material 10.

Figure 11:
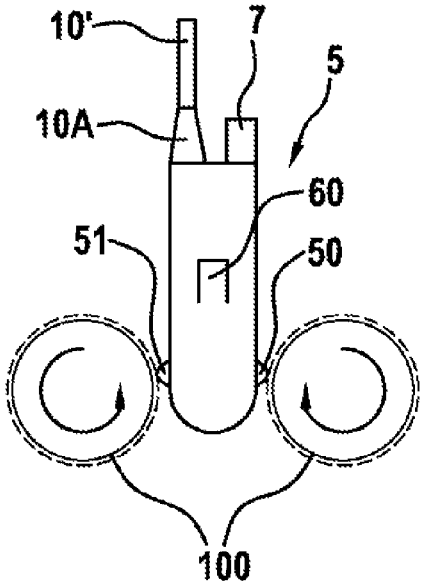

As shown in FIG. 11, the contact portions 50, 51 are then coated in an electroplating cycle, for example using a roll-brush method, by means of coating rollers 100 with an electrically conductive material, such as for example nickel, tin or gold. As an alternative to this, said operating step can also be omitted if the strip material 10 used for example already has partially gold-plated portions at the positions of the contour regions 5F or the recesses 5E to be punched. As an alternative to this, it is also possible to rotate the contact tongues 5, which are suspended from the connecting tongues 10A, back by 90° in an additional operating step. As a result, the balance of the strip material 10' of the strip material 10 including the contact tongues 5 can be rolled up and stored in a simple manner or can be transported for subsequent separating when fitting the direct plug-in elements 2.

In addition, the production of the direct plug-in element of the invention also enables assembly in a plug with a plurality of direct plug-in elements, adjacent direct plug-in elements being able to be fitted in each case alternately rotated by 180° about their longitudinal axis. In this case, it is possible for only one contact portion 50, 51 to be in contact in each case. In the case of this type of alternating fitting, in each case the fastening portion 7 of adjacent direct plug-in elements 2 would be located on the plug alternately at the top and at the bottom. This is a great advantage, in particular where the plug is miniaturized, as small grids are made possible as a result.

What is claimed is:

1. A direct plug-in element, comprising:

a plug housing (3), a direct contact (4) having a contact tongue (5), wherein the contact tongue (5) has at least one electrical contact portion (50) for directly contacting an exposed electrical contact region on a counterpart within the plug housing, and a latching mechanism (6) for a latching connection between the plug housing (3) and the direct contact (4) in order to keep the direct contact (4) in the plug housing (3), wherein the direct contact (4) is arranged in the plug housing (3), wherein the contact tongue (5) has a first and second flat side (52, 53) and a first and second narrow side (54, 55), wherein the latching mechanism (6) has a first latching element (60) on the direct contact (4) and a second latching element (61), which is formed in a complementary manner to the first latching element (60), on the plug housing (3), wherein the first latching element (60) is arranged on one of the flat sides (52, 53) of the direct contact (4) and wherein the contact portion (50) is arranged on one of the narrow sides (54, 55) of the contact tongue (5), wherein the contact portion (50) is formed by a contour region (5C) of an outer contour (5B) of the contact tongue (5), and wherein an end portion (5D) of the contour region (5C) is bent round by 180° in the plane of one of the flat sides (52, 53).

2. The direct plug-in element as claimed in claim 1, characterized in that the contact tongue (5) has a first and a second contact portion (50, 51), wherein in each case one of the contact portions (50, 51) is arranged on one of the narrow sides (54, 55) of the contact tongue (5).

3. The direct plug-in element as claimed in claim 2, characterized in that the contact tongue (5) is formed in a curved manner and has resilient characteristics in a direction of the latching mechanism (6).

4. The direct plug-in element as claimed in claim 3, characterized in that the first latching element (60) is arranged on a convex region (5A) of the curved contact tongue (5).

5. The direct plug-in element as claimed in claim 4, characterized in that the latching mechanism (6) is releasable.

6. The direct plug-in element as claimed in claim 5, characterized in that the plug housing (3) has an end-face opening (3A).

7. The direct plug-in element as claimed in claim 1, characterized in that the contact tongue (5) is formed in a curved manner and has resilient characteristics in a direction of the latching mechanism (6).

8. The direct plug-in element as claimed in claim 1, characterized in that the latching mechanism (6) is releasable.

9. The direct plug-in element as claimed in claim 1, characterized in that the plug housing (3) has an end-face opening (3A).

10. The direct plug-in element as claimed in claim 1, characterized in that the direct contact (4) is aligned substantially in a direction of a cable (8) which is fixed on the direct contact (4).

11. An electric arrangement, comprising the counterpart with exposed contact regions and the direct plug-in element as claimed in claim 1.

12. The direct plug-in element as claimed in claim 1, characterized in that the direct contact (4) is aligned substantially in a direction of a cable (8) which is fixed on the direct contact (4).

13. The direct plug-in element of claim 1, wherein the contact portion protrudes laterally parallel to the plane of one of the flat sides.

14. A method for producing a direct contact (4) comprising a contact tongue (5) with at least one electrical contact portion (50, 51) configured to directly contact an exposed electrical contact region on a counterpart within a plug housing, and one latching element (60), said method comprising the steps:

punching out an outer contour (5B) of the direct contact (4) from a strip material (10) and punching or embossing a region (60A) for the latching element (60) on a flat side (53) of the direct contact (4), wherein the direct contact (4) is still suspended from a balance of the strip material (10'), producing the contact portion (50, 51) by bending round an end portion (5D) of at least one contour region (5C) of the outer contour (5B) by 180° in the plane of one of the flat sides (52, 53), producing the latching element (60) by pressing out the region (60A), rotating the direct contact (4), which is still suspended from the balance of the strip material (10'), about an angle with respect to the balance of the strip material (10') such that the contact portion (50, 51) protrudes out of a strip material plane (E), coating the contact portion (50, 51) of the direct contact (4) with an electrically conductive material, and forming a portion of the direct contact in a curved manner such that the latching element is arranged on a convex region of the direct contact.

15. The method as claimed in claim 14, characterized in that the angle is 90°.

16. A method for producing a direct contact (4) comprising a contact tongue (5) with at least one electrical contact portion configured to directly contact an exposed electrical contact region on a counterpart within a plug housing, and one latching element (60), said method comprising the steps:

embossing a dome-like recess (5E) in a strip material (10), punching out an outer contour (5B) of the direct contact (4) from the strip material (10), the outer contour including a contour region (5F) in which the recess (5E) is embossed, and punching out a region (60A) for the latching element (60) on a flat side (53) of the direct contact (4), punching out the recess (5E) from the strip material, producing the at least one electrical contact portion by bending round the contour region (5F) by 180° in the plane of one of the flat sides (52, 53), rotating the direct contact, which is still suspended from the balance of the strip material (10'), about an angle with respect to the balance of the strip material (10') such that the contact portion (50, 51) protrudes out of a strip material plane (E), coating the contact portion (50, 51) of the direct contact (4) with an electrically conductive material, and forming a portion of the direct contact in a curved manner such that the latching element is arranged on a convex region of the direct contact.

* * * * *